US009961948B2

(12) United States Patent
Archuleta

(10) Patent No.: US 9,961,948 B2
(45) Date of Patent: May 8, 2018

(54) KNEE PAD ATTACHABLE TO A BASE INCLUDING ROLLERS AND A BRAKE TO ASSIST WITH USER MOVEMENT ON A FLAT SURFACE

(71) Applicant: Anthony Archuleta, Santa Fe, NM (US)

(72) Inventor: Anthony Archuleta, Santa Fe, NM (US)

(73) Assignee: Mesa Digital, LLC, Albuquerque, NM (US)

( * ) Notice: Subject to any disclaimer, the term of this patent is extended or adjusted under 35 U.S.C. 154(b) by 856 days.

(21) Appl. No.: 13/733,410

(22) Filed: Jan. 3, 2013

(65) Prior Publication Data

US 2014/0182041 A1 Jul. 3, 2014

(51) Int. Cl.

| | |
|---|---|
| ***A41D 13/00*** | (2006.01) |
| ***A41D 13/06*** | (2006.01) |
| ***A41D 13/05*** | (2006.01) |

(52) U.S. Cl.

CPC ..... *A41D 13/065* (2013.01); *A41D 13/0568* (2013.01)

(58) Field of Classification Search

CPC ..... A41D 13/065; A41D 13/0568
USPC ..... 2/24, 22, 23, 62, 911
See application file for complete search history.

(56) References Cited

U.S. PATENT DOCUMENTS

| | | | | |
|---|---|---|---|---|
| 2,448,427 | A * | 8/1948 | Gordon | 280/32.5 |
| 4,892,305 | A * | 1/1990 | Lynch | 482/132 |
| 5,427,391 | A * | 6/1995 | Cooper | 280/11.19 |
| 5,464,235 | A * | 11/1995 | Goldman et al. | 280/11.212 |
| 5,725,224 | A * | 3/1998 | Kerr | 280/11.19 |
| 5,860,492 | A * | 1/1999 | Talaska | 188/5 |
| 5,870,774 | A | 2/1999 | Legenstein | |
| 6,145,853 | A * | 11/2000 | Croshaw | 280/11.221 |
| 6,219,845 | B1 * | 4/2001 | Ferriter | 2/24 |
| 6,942,605 | B1 * | 9/2005 | Sukhovitsky | 482/132 |
| 7,681,248 | B2 | 3/2010 | Legenstein | |
| 2004/0108074 | A1 * | 6/2004 | Marchetti | 156/468 |

FOREIGN PATENT DOCUMENTS

WO WO009951312 A1 * 10/1999

* cited by examiner

*Primary Examiner* — Anna Kinsaul
*Assistant Examiner* — Brieanna Szafran
(74) *Attorney, Agent, or Firm* — Luis M. Oritz; Kermit D. Lopez; Oritz & Lopez, PLLC

(57) ABSTRACT

A knee pad system includes a knee pad attached to a base that includes integrated roller balls on its exterior surface. The roller balls can roll within the base and facilitate movement of the knee pad over a flat surface when worn by a user. The improved knee pad system can include a locking mechanism selectively preventing the roller balls from moving within said base. The knee pad of the improved knee pad system can be selectively detached from and reattached to the base.

10 Claims, 3 Drawing Sheets

KNEE PAD ATTACHABLE TO A BASE INCLUDING ROLLERS AND A BRAKE TO ASSIST WITH USER MOVEMENT ON A FLAT SURFACE

INVENTION PRIORITY

The present invention claims the benefit of priority to provisional patent application Ser. No. 61/583,637 entitled "Knee Pad Attachable to a Base Including Rollers and a Brake to Assist with User Movement on a Flat Surface", which was filed Jan. 6, 2012.

TECHNICAL FIELD OF THE INVENTION

The present invention generally relates to a protective knee pad used in constructions and maintenance trades, and in particular, to a knee pad that can be attached to and detached from a base including rollers and a roller braking system.

BACKGROUND OF THE INVENTION

Knee pads are commonly used to protect knees from hard surfaces and to provide padding and comfort to users of knee pads engaged in activities that may require the user to rest on his/her knees for long periods of time. Knee pads are generally strapped around a person's leg at the knee. Attachment can be with any combination of flexible straps and/or buckles. The straps assure that knee pads remain in contact with the front of a person's leg at their knee. Furthermore, straps keep a knee pad on a knee if a person had to stand up and walk to another location.

The problem with knee pads is that they can sometimes limit a person's movement over a hard surface. Knee pads are often made of a rubbery material so the knee pads tend to stick to a smooth surface such as floor tile or concrete as a person moves along the surface to work. The user must often pick up their knee/leg and move over the surface to adjust their position on the work surface (e.g., flooring). What the present inventor believes there is a need for are knee pads that can move easily over a flat surface such as flooring. The present inventor believes that an improved knee pad system would ease a user's required effort when working on a flat surface.

BRIEF SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, a feature of the present invention to provide for an improved knee pad system that enables users to maneuver over a flat surface by including an attached base with rollers located thereon to make contact with the flat surface.

It is another aspect of the present invention to provide for an improved knee pad system that includes a braking system that allows a user to prevent rollers from moving.

It is yet another aspect of the present invention to provide for an attachment/detachment mechanism that allows the base and roller portion of the knee pad system to be detached from the knee pad.

The aforementioned aspects and other objectives and advantages can now be achieved as described herein.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

The particular values and configurations discussed in these non-limiting examples can be varied and are cited merely to illustrate at least one embodiment and are not intended to limit the scope thereof.

Figure 1:
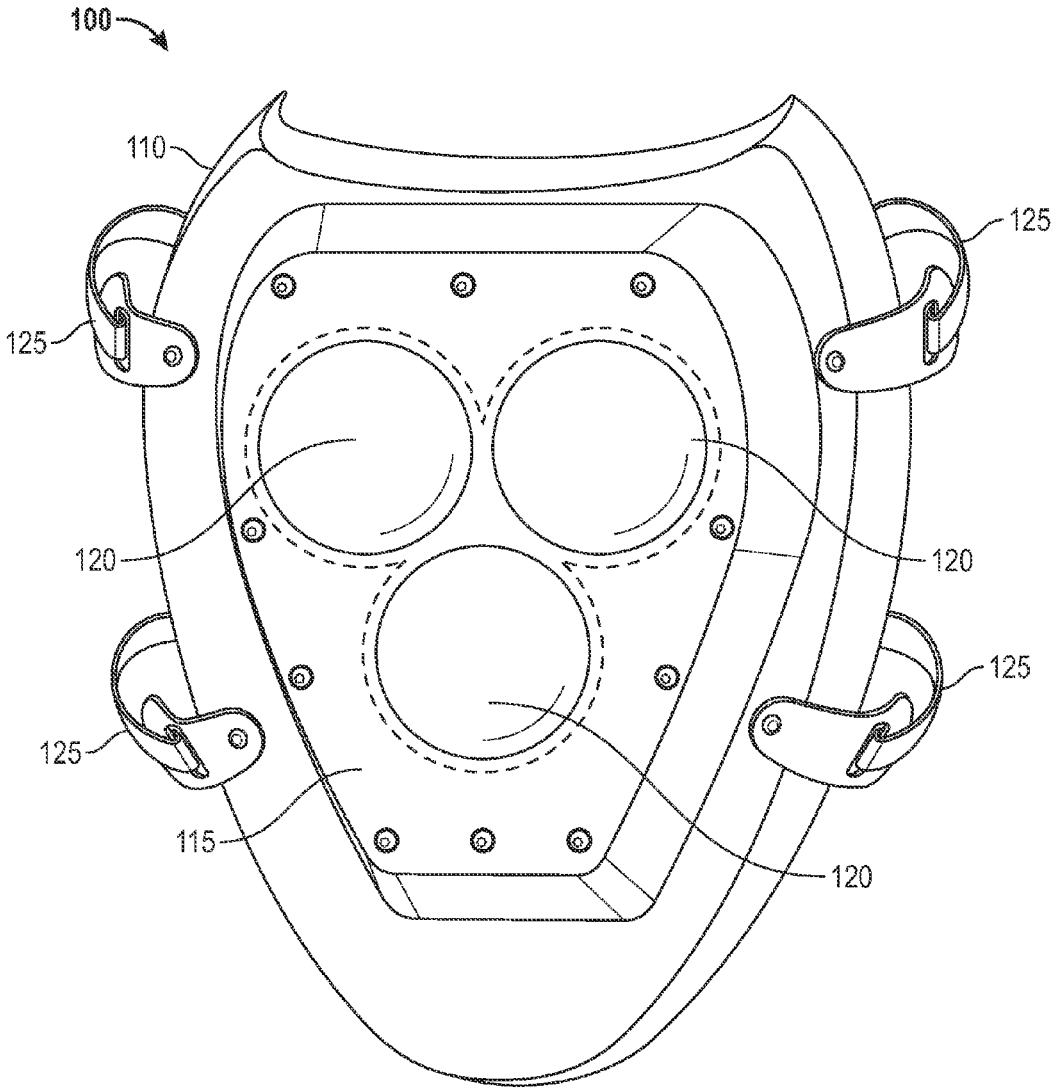
FIG. 1 illustrates a front perspective view of a knee pad including integrated rollers to facilitate movement of a user on a flat surface, in accordance with a preferred embodiment.
Figure 2:
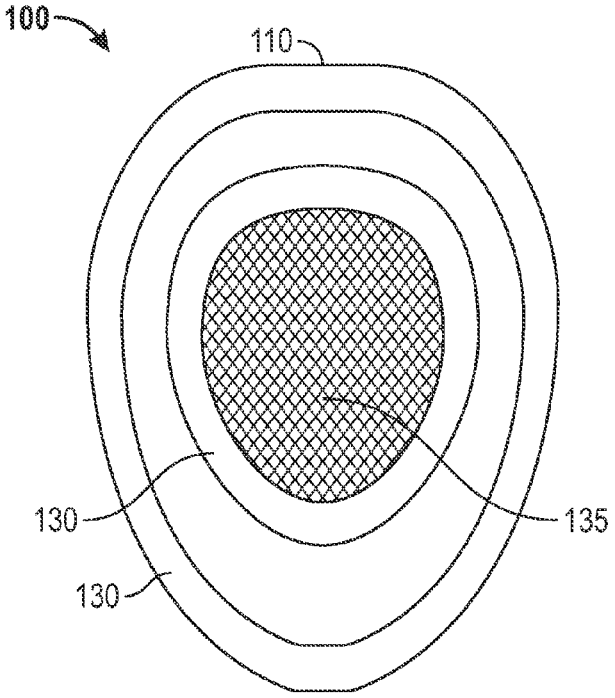
FIG. 2 illustrates a back perspective view of the knee pad of FIG. 1, in accordance with a preferred embodiment.
Figure 3:
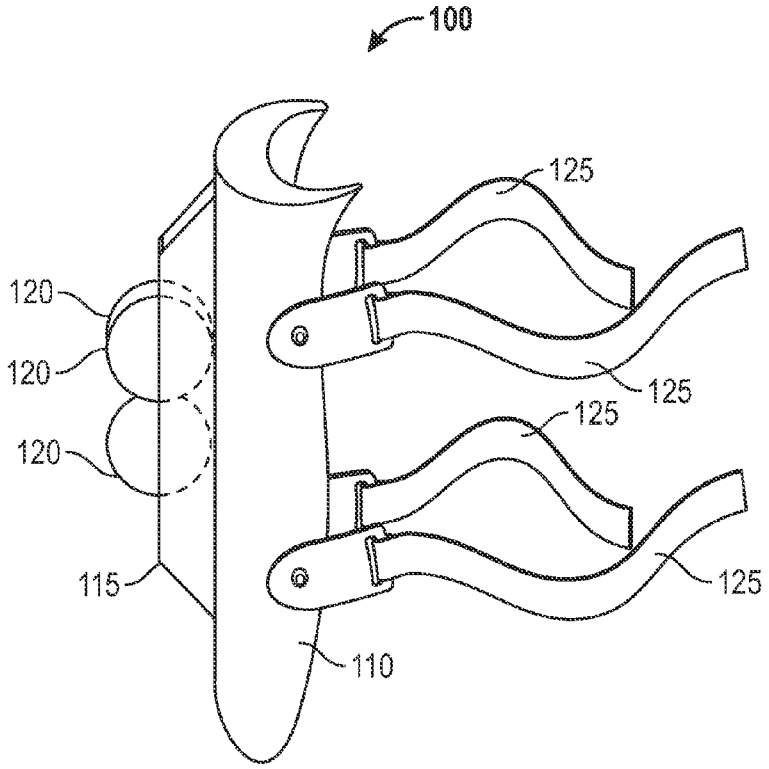
FIG. 3 illustrates a side perspective view of the knee pad of FIGS. 1 and 2, in accordance with a preferred embodiment.

FIGS. 1-3 illustrate a front perspective view of an improved knee pad system 100 including a knee pad 110 including a base 115 with integrated rollers 120 to facilitate movement of a user on a flat surface, in accordance with a preferred embodiment. Note that in FIGS. 1-3, identical parts or elements are generally indicated by identical reference numerals. The knee pad 110 includes straps 125 to secure the roller knee pad system 100 to user's knee (not shown). The straps can include a buckle system, hook and loop (e.g., Velcro™) system, and other attachment means known in the art. The base 115 acts as a carrier mechanism and can include rollers similar to a roller ball found on some computer mouse systems or similar to the roller ball concept used on wiring pens and some personal hygiene antiperspirant applicators. The roller balls can be made of a rubber material to provide additional cushion, allow for movement over rough surfaces, and to prevent skidding when an optional roller braking system (discussed in FIG. 4) is used. The base 115 can be attached to the knee pad 110 with screws such as star drive screws. Screws can be removed to remove the base from the need pad so that the roller ball system can be cleaned after extended use. It can be appreciated that the roller ball system may not roll as easily unless the system is cleaned after extended use.

Referring to FIG. 2, the back side (or interior area) of a knee pad that contacts a user's knee is illustrated. Padding 130 and a knee pad support area 135 can enhance user comfort and safety during use of the improved knee pad system 100.

Referring to FIG. 3, a side perspective of a knee pad system 100 is illustrated. Rollers 120 are shown held within the base 115 at least half way deep into the base 115. It should be appreciated that the rollers 120, similar to roller balls on a computer mouse, will actually be held within the base 115 more than half way (more than half the diameter of the roller balls) to prevent them from popping out of the base

115. The base 115 is shown attached on top of the knee pad 110. Straps 125 that would be fastened around a user's knee during use are shown attached to the kneepad system 110.

Figure 4:
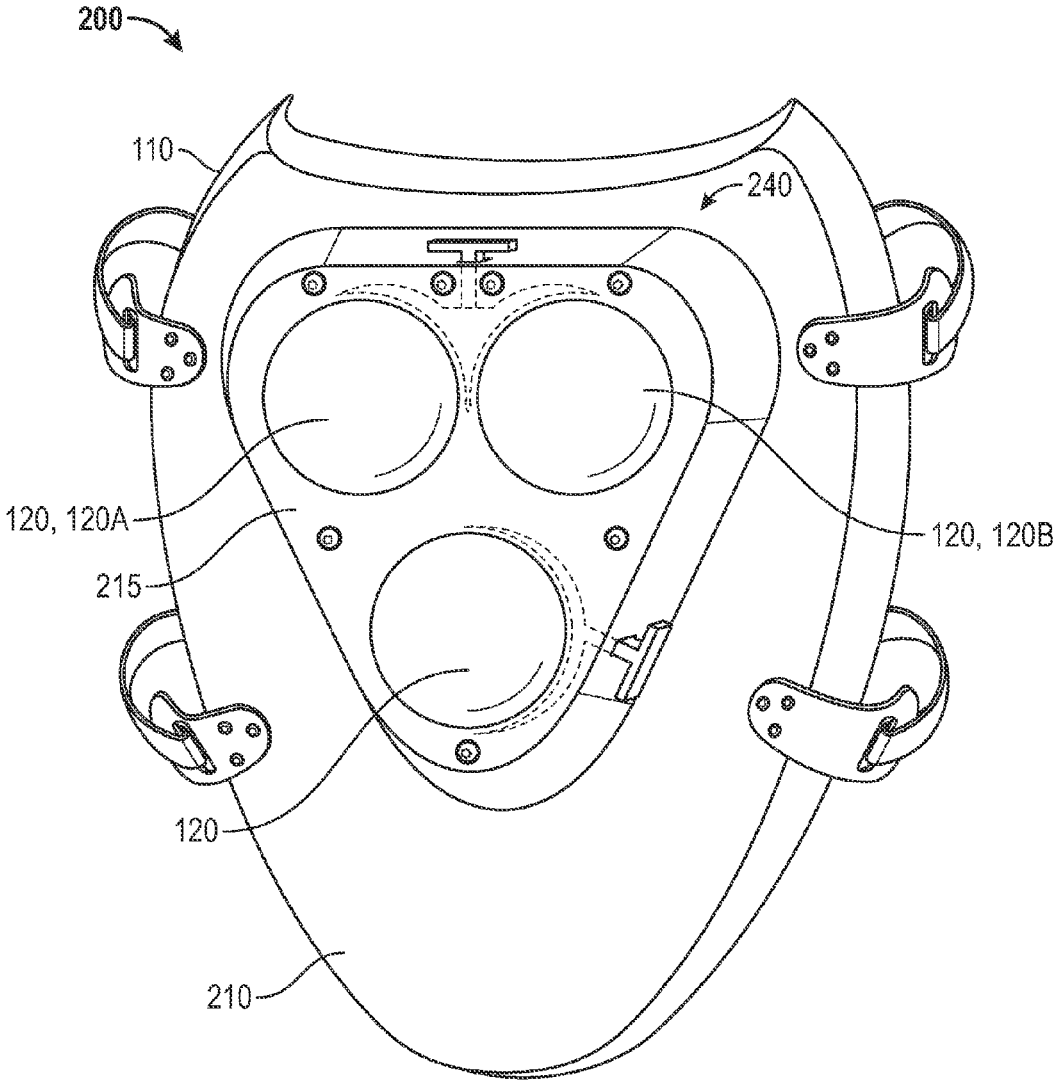
FIG. 4 illustrates a front perspective view of a knee pad including integrated rollers and a locking mechanism to selectively facilitate and prevent movement of a user on a flat surface, in accordance with an alternate embodiment.

FIG. 4 illustrates a front perspective view of a knee pad system 200 including a base 215 with integrated rollers 120 and a locking mechanism 240 disposed on a front surface 210 of the knee pad system 200. The locking mechanism 240 can be caused by a user to engage two integrated rollers 120A and 120B, and can thereby selectively facilitate and prevent movement of a user on a flat surface via the prevention in movement of the rollers 120A and 120B, in accordance with an alternate embodiment. The locking mechanism 240 can be provided in the form of a push button located near the top, front of the knee pad as shown in FIG. 4 so that the locking mechanism 240 can easily be reached by a user at the front of the user's knee. One locking mechanism is shown positioned between roller 120A and 120B. When the locking mechanism is engaged in "lock" mode, it engages roller 120A and 120B, preventing them from rolling. This also prevents movement of the knee pad and user via the rollers. When disengaged, or in "unlock" mode, rollers 120A and 120B are free to move and the knee pad and user can move along a surface that the rollers 120 are in contact with. It can be appreciated that the locking mechanism can be spring-loaded and include a locking mechanism similar to that found in cabinetry or the ball point pen arts. It should be appreciated that a slide lock mechanism (although not specifically shown) could also be used to lock the rollers 120 of the improved knee pad system 200.

It will be appreciated that variations of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. An improved knee pad system, comprising:

a knee pad attached to a base including at least three integrated roller balls, wherein the at least three integrated roller balls facilitate movement of the knee pad over a flat surface when worn by a user; and a locking mechanism disposed between at least two integrated roller balls of said at least three integrated roller balls, said locking mechanism selectively preventing said at least two integrated roller balls from moving within said base when said locking mechanism is physically engaged with said at least two integrated roller balls by the user.

2. The improved knee pad system of claim 1, wherein said knee pad is detachable from said base.

3. The improved knee pad system of claim 2, further comprising straps to secure at least one of the knee pad and the base to a user's knee.

4. The improved knee pad system of claim 2, further comprising straps to secure the knee pad system to a user's knee.

5. The improved knee pad system of claim 1, further comprising straps to secure the knee pad system to a user's knee.

6. The improved knee pad system of claim 1, further comprising straps to secure at least one of the knee pad and the base to a user's knee.

7. An improved knee pad system, comprising:

a knee pad attachable to an interior surface of a base, said base including at least three roller balls integrated onto an exterior surface, wherein said at least three roller balls facilitate movement of the knee pad and base over a flat surface when worn by a user;

a locking mechanism selectively preventing at least two roller balls of said at least three roller balls from moving within said base when said locking mechanism is physically engaged with said at least two integrated roller balls by the user; and straps attached to the knee pad system to secure the knee pad system to the user's knee.

8. The improved knee pad system of claim 7, wherein said knee pad is also detachable from said base.

9. A knee pad system, comprising:

a knee pad including straps to secure the knee pad to a user's knee and attached to a base including integrated roller balls on an exterior surface of the base, wherein roller balls facilitate movement of the knee pad and base over a flat surface when worn by a user; and a locking mechanism disposed between at least two roller balls selectively preventing said at least two roller balls from rolling within said base when said locking mechanism is selectively engaged by the user causing the locking mechanism to physically engaged and lock the at least two roller balls.

10. The kneepad system of claim 9, wherein said kneepad is selectively detachable from said base.

* * * * *